United States Patent [19]

Gärtner

[11] Patent Number: 4,524,297

[45] Date of Patent: Jun. 18, 1985

[54] THERMIONIC CATHODE AND METHOD OF MANUFACTURING SAME

[75] Inventor: Georg Gärtner, Aachen, Fed. Rep. of Germany

[73] Assignee: U.S. Philips Corporation, New York, N.Y.

[21] Appl. No.: 416,840

[22] Filed: Sep. 13, 1982

[30] Foreign Application Priority Data

Feb. 18, 1982 [DE] Fed. Rep. of Germany ..... 3205746

[51] Int. Cl.[3] ..... H01J 1/13

[52] U.S. Cl. ..... 313/346 R; 313/351; 313/338; 445/50; 445/51

[58] Field of Search ..... 313/346 R, 346 DC, 338, 313/351; 445/50, 51

[56] References Cited

U.S. PATENT DOCUMENTS 2,878,409 3/1959 Levi ..... 313/346 DC
3,290,543 12/1966 Weissman ..... 313/346 R

FOREIGN PATENT DOCUMENTS 2454569 4/1976 Fed. Rep. of Germany ... 313/346 R
1150153 1/1958 France ..... 313/346 R
1137124 12/1968 United Kingdom ..... 313/346 R
439028 1/1975 U.S.S.R. ..... 313/346 R
510760 6/1976 U.S.S.R. ..... 313/346 R

*Primary Examiner*—David K. Moore
*Assistant Examiner*—Vincent DeLuca
*Attorney, Agent, or Firm*—Robert J. Kraus

[57] ABSTRACT

A cathode having a layer structure in which alternate layers consisting essentially of emitter material (2) and base material (1) are provided at an oblique angle to the cathodes's macroscopic emitting surface. In a preferred embodiment the surface has a microscopically stepped structure formed by ends of the base material layers and portions of the emitter material layers coating the ends. In an alternative embodiment the surface is not stepped but is formed by a polycrystalline or a preferentially oriented polycrystalline coating layer which is provided on the succession of beveled layers. The succession of layers is manufactured by alternating depositions from the gaseous phase and by subsequent bevel grinding of the layers. The polycrystalline coating layer is provided by deposition from the gaseous phase. The stepped surface is formed, for example, by selective structure etching after the bevel grind.

18 Claims, 5 Drawing Figures

THERMIONIC CATHODE AND METHOD OF MANUFACTURING SAME

BACKGROUND OF THE INVENTION

The invention relates to a thermionic cathode comprising a cathode body consisting of a high-melting-point base material and a store of emitter material and an electron-emitting monolayer on the surface of the cathode body. The monolayer during operation of the cathode is replenished from the store of emitter material. The invention also relates to a method of manufacturing such a thermionic cathode. Such cathodes will hereinafter also be referred to as dispenser cathodes or monolayer cathodes.

Thermionic monolayer cathodes with thorium as an electron-emissive material or emissive material on tungsten as a high-melting-point base material or base matrix have long been known U.S. Pat. No. 1,244,216. Such cathodes have already been intensively investigated but due to their wide-spread commercial use because of their good vacuum behaviour, their very high emission and their favourable properties when used in UHF and microwave tubes, a further improvement in particular of the emission is necessary in view of the more stringent requirements.

Such thermionic monolayer cathodes generally consist of a base matrix of a high-melting-point-metal in which emitter material is incorporated elementarily or in the form of a compound. At the operating temperature the emitter material diffuses in the form of atoms to the surface of the cathode, for example, by grain boundary diffusion, volume diffusion or through pores, and forms or replenishes a surface monolayer. The monoatomic layer of emitter atoms on the surface is supported by desorption. In the case of thoriated tungsten cathodes, Th is liberated from $ThO_2$ thermally, and preferably by reaction with $W_2C$, and diffuses along the grain boundaries to the tungsten surface.

With a suitable choice of the emitter material and the base material, the dipole field between the monolayer and the underlying atoms of the base material generates an additional reduction of the emitter work function for thermionic electrons so that monolayer cathodes have a higher electron emission than cathodes of pure emitter material. For example, the work function for pure Th is approximately 3.5 eV, while for a Th monolayer on tungsten it is only 2.8 eV.

However, perfect operation of the cathode is obtained only when the overall emissive surface is covered by the mono-layer, that is by a mono-atomic film. This condition becomes critical at higher temperatures, at which a sufficient coating and hence emission is no longer ensured due to strong desorption of the emitter atoms. In the case of Th-[W] (thiorated tungsten) cathodes, such an emission decay occurs at approximately 2200 K. where the emission finally falls to that of pure tungsten. The temperature at which the emission decay occurs, however, does depend on the grain size, especially for dispenser-type cathodes with a monolayer replenished via grain boundary diffusion. Since the emitter atoms spread across the surface via surface diffusion, in which the sources of the emitter atoms are the grain boundaries, smaller crystallites lead naturally to a better coating with respect to equal diffusion length.

There has been an unsolved problem for decades regarding emission and thorium diffusion length. From measurements of the thorium desorption rates $\nu_D$ of tungsten and measurements of the surface diffusion constant $D_\delta$ for thorium on polycrystalline tungsten the diffusion length can be given as $\sqrt{D_o \cdot c_o/\nu_D}$ where $c_o=1$ represents the relative Th concentration at the edge of the source. This theoretically required diffusion length, however, is some orders of magnitude larger than that which can be calculated from the average grain sizes and the temperature of the emission decay. I. Langmuir gave a possible explanation of this phenomenon by means of the so-called "boundary effect" (Journal of The Franklin Institute 217 (1934) 543–569). According to this article, increased thorium desorption occurs at the edges of the individual tungsten crystallites, that is to say at the thorium emanating places, for example, dependent on strongly inhomogeneous fields. This means of course an increase migration resistance and a shortening of the actual diffusion length. So it must be an object of a cathode improvement to obviate the boundary effect by suitable structuring of the cathode.

Besides the boundary effect, however, there is a further limitation of cathode emission to be eliminated. The subtractive dipole field between the emitter-monolayer and the base material depends considerably on the crystallite orientation of the base. In the usual polycrystalline non-textured cathodes, for example, in all conventional powder metallurgically manufactured monolayer cathodes, this leads to location dependent, strongly varying electron emission in which the lowest work function is achieved only in a few fortuitous, favourably oriented crystallites. So-called "Patchy emitters" are obtained.

From DE-OS No. 1439890, corresponding to U.S. Pat. No. 3,284,657, a method is known to coat conventional monolayer cathodes with a polycrystalline preferentially orientated layer, for example, of the base material, in which that preferential orientation of the coating layer is provided which causes the strongest reduction of the work function. In this manner, homogeneously emitting cathodes with increased emission current density are obtained to a good approximation, since all faces contribute to a similar extent to the emission. In the case of Th-[W] thoriated tungsten cathodes, for example, the <111> is the most favourable W orientation. However, the high electron emission of such preferentially oriented cathodes does not remain stable in time, the texture being partly destroyed even during activation.

SUMMARY OF THE INVENTION

An object of the invention is to provide a suitable cathode structure and a method of manufacturing said structure, with which it is possible to avoid the boundary effect in Th-[W] thoriated tungsten and analogous monolayer cathodes. Another object is to increase and maintain stable in time the emission, by fine crystallinity of the base material and a suitable texture, as well as by ensuring the thermal stability of the texture.

According to the invention these objects are achieved by a cathode of the kind mentioned in the opening paragraph in which the cathode body consists of a succession of layers comprising the base material and intermediate layers with a high concentration of the emitter material and that the macroscopic cathode surface bearing the monolayer extends obliquely to the major surfaces of the layers where they meet the macroscopic cathode surface.

According to the invention the succession of layers is preferably manufactured by alternating depositions of the high-melting-point base material and the electron emissive material from the gaseous phase and the macroscopic emissive surface is then manufactured by a bevel grind.

A preferred cathode structure according to the invention is as follows:

The cathode consists of a succession of layers arranged obliquely to the emissive cathode surface and consisting alternately of high-melting-point base material and of emitter material. The thickness of the layers is in the range from less than a few μm to 0.01 μm, the emitter material layers being significantly thinner than the base material layers. The electron-emissive material which preferably is an element of the scandium group, in particular thorium, or one of its compounds, is distinguished in that it reaches the surface substantially by grain boundary diffusion through the high-melting-point base material, in particular tungsten, and spread there by surface diffusion. As base materials are used in addition to W also Mo, Ta, Nb, Re and/or C, the composition of the base materials in the individual layers of the succession of layers being the same or different.

The surface has a stepped structure in which the strongly emissive step tread surfaces form the continuation of the emitter material layers. The emitter atoms diffuse directly without edge inhomogeneities on the run-out steps and form a monolayer there. In a preferred embodiment of the invention the base material layers have a suitable preferred orientation with respect to the normal to the layer, in Th-[W] cathodes, for example, this is the <111> orientation for the W base material. The cathode material is finely crystalline with grain sizes ≦1 μm. It is also favourable when the grain diameter is slightly larger than the stepwidths. The temporal stability of the texture is achieved by doping the base material with components which are poorly soluble or are not soluble therein at all. Further dopants in the edge zone of the emitter material layers effect better release of the emitter atoms when the emitter material is in the form of a compound.

In a further embodiment of the invention the surface of the bevel-ground layer structure is coated with a polycrystalline layer, if desired a preferentially oriented layer, of base material or another material which in combination with the emitter monolayer generates a strong reduction of the electron work function. The boundary of the bevel layer to the coating layer is usually smooth without projecting steps. The coating layer is finely crystalline.

The cathode according to the invention is preferably manufactured in three manufacturing steps. In the first step a succession of layers is first manufactured by alternating deposition from the gaseous phase of the high-melting-point base material and of the electron-emissive material.

A method for the alternate deposition of base material and electron-emissive material is suggested in West German Patent Application No. P 31 48 441. 7, corresponding to U.S. patent application Ser. No. 447,079 filed Dec. 6, 1982. This method and its embodiments (also for simultaneous deposition) may be used in the method according to the invention. The provision of the layers is carried out by reactive deposition, for example, CVD method, pyrolysis, cathode sputtering, vacuum condensation or plasma sputtering. In a particularly advantageous embodiment of the suggested method the gases taking part in the deposition reaction are generated by producing a plasma for the chemical conversion and associated deposition of cathode material (so-called plasma activated CVD method or PCVD). Instead of using high frequency generation the chemical reaction may also be generated or induced, respectively, by photons or by electron impact. When applied to the preferred material combination Th-W, this means that first a succession of layers of pure tungsten or tungsten doped with a stabilizer alternating with $ThO_2$ layers are deposited reactively from the gaseous phase onto a suitable substrate. When organometallic starting compounds are used, a carburization of the equally deposited base material is simultaneously achieved in the Th-CVD. In a preferred embodiment <111> oriented tungsten is deposited by suitable adjustment of the CVD parameters.

The succession of layers is preferably manufactured by reactive deposition with temporal variation of the parameters, in particular of the flow rates of the gases taking part in the reaction and/or the substrate temperature. According to a particular embodiment of the method according to the invention the temporal variation of the parameters of the reactive deposition occur substantially periodically (alternating CVD method).

In the second process step the layers after the deposition are bevel-ground, preferably at an angle of 20° to 70°, in particular 45°. The bevel grind according to the invention is carried out, for example, by mechanical operation, such as grinding or milling, and/or mechanical-chemical micropolishing, or by dressing by means of a laser beam.

In the third process step a stepped structure of the surface is manufactured by etching. A suitable etchant for the combination Th-W is, for example, a 3% by weight solution of $H_2O_2$. The stepped microstructure of the surface, however, may also be produced by means of other methods. These include, for example, the local evaporation of base material by means of an intensive laser beam or electron beam which is passed over the grinding face at the emanating sides of the emitter layers. There is also the possibility of roughening the surface by mechanical operations, such as fine lapping, and carrying out a thermal treatment for the recrystallization of surface crystallites. The tilted emitter material-intermediate layers with their small mechanical stability are one of the causes in the last-mentioned method for the combination of the occurrence of the stepped structure and for the inhibition of the base material recrystallizing at the emitter material-intermediate layer, respectively. The steps are constructed so as to be in the elongation of the layers with high concentration of emitter material, the stepped grooves being at right angles thereto. As a result of this the emitter material can diffuse directly from the layers of high emitter material concentration to the surface of the run-out steps without strong desorption at grain boundaries.

By the suitably adjusted preferred orientation of the layers it is achieved in addition that the lowest work function from the emitter-monolayer-base combination is realized everywhere on the runout steps. In the stepped grooves the crystallites are naturally oriented at random. However, their share in the overall surface can be considerably reduced by using an angle of inclination of the layer planes smaller than 45°. for example, 25° with respect to the macrosurface.

For stabilization of the manufactured microstructure and microcrystallinity of the cathode material of the monolayer cathodes according to the invention with grain boundary dispensing, the method according to the invention is completed by simultaneous deposition of additional dopants. This is again demonstrated with reference to the typical example of Th-W cathodes. When the temperature of Th-$[W]_C$ cathodes is increased over the normal operating temperature of 2000 to 2100 K., a strong reduction of the emission occurs, in particular from 2200 K., due to increasing Th desorption from the monolayer, that is decreasing Th-coating, so that an increase in emission cannot be produced by raising the temperature. This decrease of the emission depends critically on the average grain diameters and occurs at higher temperatures for smaller average grain sizes. In Th-[W] cathodes an average tungsten grain diameter of approximately 1 μm means an extension of the useful temperature up to 2400 K. Such small grain sizes can be manufactured substantially only by CVD methods and even then only by suitable choice of the parameters. This microcrystallinity must naturally also remain stable with respect to longer thermal loads. For example, when during operation of the cathode the grain sizes increase substantially by recrystallization, deterioration of the monoatomic coating causes a decrease of the emission current and hence a shorter life. The same stability requirement also applies to the texture, that is to say the adjusted preferred orientation at the surface must be maintained.

Analogous to the mechanical stabilization of a supporting layer, recrystallization is prevented by the addition of a material which is insoluble in the crystal lattice of the coating layer material and which is deposited simultaneously from the gaseous phase and at the same time produces a stabilization of the texture. When tungsten is used as a coating layer material or a base material, the dopants Th, $ThO_2$, Zr, $ZrO_2$, $UO_2$, Y, Sc, $Y_2O_3$, $Sc_2O_3$ and Ru are suitable due to their low solid solubility in tungsten. At an operating temperature of 2000 K. which implies the melting-point of the dopant should be higher, and when simple handling is required, $ThO_2$, $ZrO_2$, $Y_2O_2$, $ScO_2$ and Ru remain as preferred CVD dopants. The dopant may be identical to the emissive material, in case Th, Y or Sc form the emitter monolayer.

During the manufacture of a monolayer cathode according to the invention having an arbitrary surface shape, a further operating step may be performed, if desired, after grinding, namely the arrangement of individual dressed facets to one cathode body of the desired surface geometry, for example, by means of an intarsia technique. Another possibility which has been described in detail in the embodiments consists in the use of grooved substrates (see FIG. 4).

In a further preferred embodiment of the method according to the invention a polycrystalline coating layer or a preferably oriented polycrystalline coating layer is provided via a deposition from the gaseous phase on the face manufactured by bevel grinding. One of the few possibilities of manufacturing a preferentially oriented polycrystalline coating layer is again the chemical deposition from the gaseous phase, in which it is advantageous to maintain certain combinations of the deposition parameters, in particular of the substrate temperature and flow rate of the gas mixture. The coating layer consists of pure high-melting-point metal, for example, W, Mo, Ta, Nb, Re, Hf, Ir, Os, Pt, Rh, Rh, Ru, Zr or C and should have a preferred orientation. The material and its texture are chosen such that the work function from the combination emitter monolayer-coating layer becomes even lower than that of the emitter-base combination. The coating layer generally consists of a metal of high work function which reduces the work function correspondingly via a high dipole moment between the emitter film and the coating layer. A condition for a good surface coating is again either fine crystallity of the coating layer of the emitter material or the presence of sufficient volume diffusion in the coating layer.

BRIEF DESCRIPTION OF THE DRAWING

A few embodiments of the invention are shown in the drawing and will be described in greater detail hereinafter. In the drawing

DESCRIPTION OF THE PREFERRED EMBODIMENTS

Figure 1:
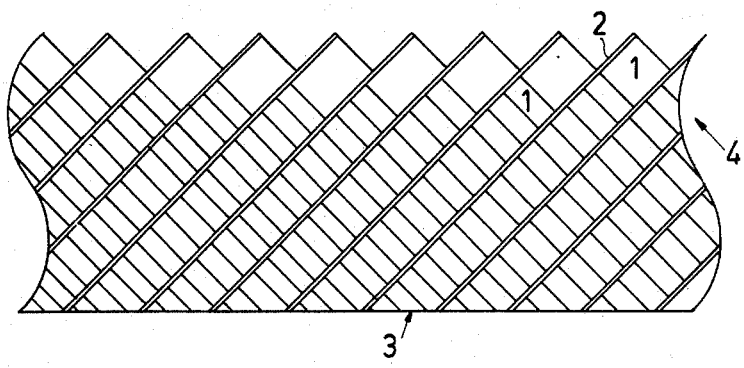
FIG. 1 is a broken-away sectional view through a cathode.

Reference numeral 1 in FIG. 1 denotes base layers of grain-stabilized, i.e. doped tungsten. These layers are 1 to 2 μm thick. Reference numeral 2 denotes Th monolayers on W<111>. 3 denotes intermediate layers of $ThO_2$ of 0.1 to 0.5 μm thickness. In the edge zone of the intermediate layer a $W_2C$ enhancement is provided which serves for the release of Th from $ThO_2$. The intermediate layer 3, however, may also consist of $ThO_2$ and $W_2C$ (as a mixture). 4 denotes the direction of deposition.

The total cathode is generally a flat cathode which is directly or indirectly heated. The sequence of layers itself is obtained by a high-frequency alternating deposition of W and $ThO_2$ which are doped, if desired. The high-frequency sequence of layers is achieved via a computer control of the process, in particular of the mass flow of the different gaseous compounds. The substrate temperature is approximately 500° C., the pressure in the reactor 10 to 100 mbar, preferably 40 mbar. In the W-CVD the $WF_6$ flow rate is approximately 30 $cm^3$/minute with an approximately 10-fold $H_2$ flow rate. The interval duration is up to a few minutes, for example 1 minute. In the intervals in between, $ThO_2$ and $ThO_2+W_2C$, respectively, are also deposited approximately 1 minute via Ar as a carrier gas for thorium acetylacetonate or fluorinated Th acetylacetonate and $WF_6.Th(C_5H_7O_2)_4$ in powder form in a saturation device through which approximately 85 $cm^3$/minute of Ar flow and which is heated to a temperature of approximately 160° and near to the melting-point of the Th compound, respectively. The reaction temperature is approximately 20° C. higher.

An additional $W_2C$ enhancement at the edge of 3 is obtained either by a short lasting (approximately 8 seconds) introduction also of a hydrocarbon-containing gas at the beginning of the new W-CVD interval or by a stopper $WF_6$ enhancement towards the end of the Th deposition, in particular in Th trifluoracetylacetonate as a starting compound. As an alternative to the carburization a boronation of the edge zone is also advantageous.

Figure 2:
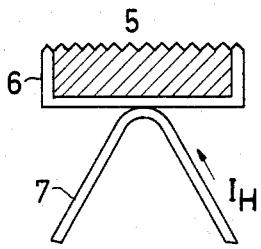
FIG. 2 is a total cross-sectional view of the cathode shown in FIG. 1.

At very high-frequency deposition of W and Th, a doping of W may be omitted, if desired, since grain stabilization is already ensured by the intermediate layers. In sequence of layers with more than 2 μm spacing doping of the CVD-W with a substance which has a low solubility in W or is insoluble in W, for example 1% by weight $ThO_2$, $ZrO_2$, $Y_2O_2$, $Sc_2O_3$ or Ru is of advantage. The flow rate of $WF_6$ is adjusted so high as to just lead to a deposition of W in the <111> direction at the substrate temperature in question. After deposition of approximately 1000 to 2000 sequences of layers the CVD sample is moulded or clamped and ground flat at an angle of 45° to the direction of growth or is dressed by means of a laser. The other sample sides are then also ground and provided by CVD deposition with an approximately 50 to 150 μm thick Re or W coating 6 (FIG. 2). The resulting sample is then spot-welded to a hair pin 7 for heating. The uncoated ground cathode surface provided for emission is again micropolished to a few tenths of a μm and is then etched carefully with a structure etchant suitable for W so that the desired step-shaped surface structure is obtained. A suitable structure etchant for W is, for example, a 3% by weight solution of $H_2O_2$.

When a partial conversion of the Th compound and of $ThO_2$, respectively, to metallic thorium is carried out after the CVD deposition, and electrochemical etching treatment with a solution of $14CH_3COOH:4HClO_4:1H_2O$ (temperature 10° C.) for current durations ($i \leqq 0.1$ A/cm$^2$) $\leqq 1$ sec. is carried out prior to the W structure etching, which acts directly on the intermediate layers. Also with a tungsten carbide enhancement in the intermediate layer, first a pre-etching for the step structuring may take place with known etchants acting on WC and $W_2C$, respectively (for example, electrochemically with 2 g NaOH, 2 g Na-tungstate and 100 ml of water).

The cathode structure and its method of manufacturing described in this example do not apply only to the emitter-base combination Th-W, but to any combination of an emitter with a high-melting-point metal in a monolayer cathode, in which the emitter dispensing occurs substantially via grain boundary diffusion. Such materials are also to be found, for example in the scandium group: For the combination Y-W and Sc-W the above cathode structure also represents a preferred structure. For the deposition of Y and Sc-oxide, respectively, the corresponding acetylacetonates may be used.

Figure 3:
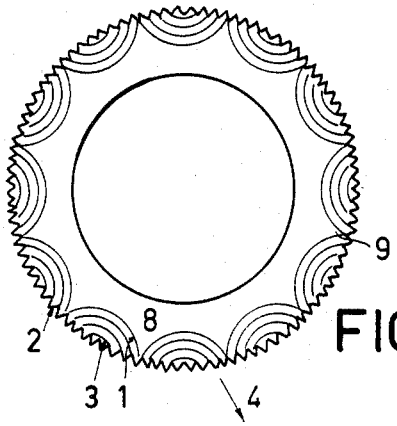
FIG. 3 is a sectional view through a cylindrical cathode having a stepped outer surface.
Figure 4:
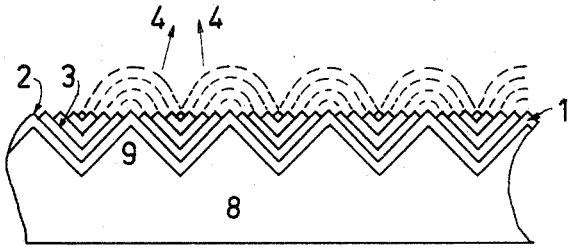
FIG. 4 is a sectional view through a cathode having a flat substrate with sawtooth grooves.

In contrast with the manufacture of the planar cathode of FIG. 2, the manufacture of a cylindrical cathode having a stepped outer surface becomes significantly more difficult. This problem can be solved either by making the cylinder surface from a few (slightly curved) sections, for example, by spot-welding or another mosaic (intarsia) technique which may also be used for cathodes of any surface shape. For cylindrical cathodes it is suitable in addition to coat and then grind round an elliptical substrate or a substrate 8 having a tooth-like cross section (longitudinally ribbed cylinder surface) as in FIG. 3 and to then carry out the step structuring. A longitudinally ribbed cylinder substrate 8 provides quite a uniform electron emission density distribution on the surface circumference in the case of a high number of ribs 9. As a result of the increase of the number of ribs on the circumference, substrates of a smaller thickness may be used due to the associated reduction of the depth of the ribs, which is advantageous for cathode heating. For special applications such as magnetron cathodes, cylinder substrates having an elliptical cross-section may be used and an inhomogeneous distribution of the emanating electrons resulting from different step widths can be generated forming for example, four maxima in the emanating electron density. Ribbed surfaces are used advantageously for both plane substrates and substrates having any curved surface. In the case of plane cathodes, the facet-like composition of large faces is avoided, for which purpose a mosaic (intarsia) technique would normally be used. When for example a macroscopically "plane" substrate as in FIG. 4 is used having sawtooth-like grooves, the limiting condition holds for a parallel growth of the inclined groove surfaces that the reactive deposition from the gaseous phase occurs in the so-called range controlled by surface reaction controlled regime, i.e. the dispensing of the gaseous starting compounds to the surface is not limited by gasphase diffusion, so the deposition temperature must be chosen in the lower temperature range with respect to the inflection point of the growth characteristic. The depth of the grooves lies in the range from 10 to 20 μm and approximately 10 to 20 successions of layers are provided. In a Th-W cathode the W layers are again <111> preferentially oriented and deposited while doped with a structure-stabilizing component.

After the CVD layers have been deposited the surface is ground smooth in accordance with the substrate geometry chosen and the surface is provided with micro steps according to any of the described methods, the step tread surfaces again corresponding to the run-out faces of the emitter material-intermediate layers 3. The steps are produced, for example, by structure etching. The substrate 8 consists, for example, of molybdenum in which the grooves 9 are manufactured by mechanical operations. Reference numeral 1 in FIG. 4 again denotes the base material layers, 3 are the emitter material-intermediate layers, 2 are the run-out steps coated with the monoatomic emitter layer and 4 denotes the deposition direction in the CVD deposition. The removed part of the CVD layers is shown in broken lines.

The decisive advantages of the cathodes according to the invention having a stepped surface are as follows: The most important advantage is based on the suppression of the boundary effect. The emitter atoms diffuse, without strong desorption at the surface grain boundaries, unhindered across the run-out steps and form a monolayer there. For Th-[W] cathodes according to the invention the critical temperature rises by approximately 200° C. due to the much lower side desorption and the emission maximum also occurs only at a higher cathode temperature (approximately 2100 K.). Thus stepped cathodes according to the invention present the possibility of reaching a higher emission current density via temperature increase than is usual in the conventional Th-W cathodes. Moreover at the usual operating temperature the consumption of emitter material is smaller, and the life is consequently extended with the same store of emitter material.

A further advantage is that the effective emitting surface is expanded by the stepped structure; when grinding at 45° the enlargement factor is approximately 1.4 which is favorable for Th-[W] cathodes at temperatures below 2000 K.

Figure 5:
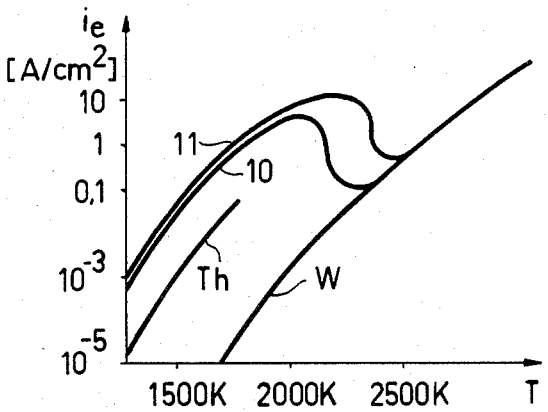
FIG. 5 shows a graphic representation of the dependence of the saturation emission current density on the cathode temperature.

A further important advantage of the invention is based on the deposition of the base material layers with that preferred orientation for which the work function of an emitter monolayer on said crystallite-oriented base becomes minimum. In Th-[W] cathodes this is the <111> orientation of W. The run-out steps themselves are <111> oriented in a direction normal to the layers; the side surfaces of the steps are oriented such that they contribute little to the overall emission. It is hence advantageous to increase the preferentially oriented surface parts of the run-out steps by a flatter angle of grinding, for example 30°, which again means an increase of the overall emission curve 11. FIG. 5 shows graphically the approximate variation of the emission current density $i_s(T)$ of a stepped Th-W cathode according to the invention in relation to the cathode temperature T. In comparison therewith curve 10 shows $i_s(T)$ for a conventional thorated W wire cathode. A stabilization of the texture of the W layers is achieved by additons of approximately 1% by weight of, for example, $ThO_2$, $ZrO_2$, $Y_2O_3$ and/or Ru which are substantially insoluble in W. This doping produces in addition an inhibition of the grain growth which preferred as it is, due to the intermediate layers only indirectly plays a part in the base material layers. The diffusion of the emitter material to the surface occurs along the intermediate layers 3 and is not impeded by lateral crystallite growth of the base layers.

This unimpeded supply of the emitter material to the surface is used in a further embodiment of the invention: The succession of beveled layers which in this case need not show a preferred orientation is coated, after grinding, by reactive deposition from the gaseous phase, with a polycrystalline preferentially oriented coating layer of base material, for example <111>W for a Th-W cathode or another high-melting-point material of lower work function from the emitter mono-layer-coating layer combination. The thickness of the coating layer is in the range from approximately 2 to 20 μm, preferably 5 to 10 μm. The average grain sizes and grain diameters, respectively, are adjusted to values ≦1 μm via a choice of the CVD parameters (low temperature ≦500° C. and dopings as above). When an intersia technique is used for arbitrary surface forms, the CVD coating occurs after combination of the single pieces to the desired surface form. The range of favourable grinding angles in this embodiment of the invention lies between 20° and 90°.

The most important advantage of this embodiment lies in the supply of the emitter material to the surface, unimpided by grain growth, associated with a high store and a lower desorption than, for example, in MK (metal capillary) cathodes, which means an increase of the life as compared with the usual Th-W cathodes. At the same time the emission by the <111> textured and texture stabilized coating layer is increased as compared with known Th-W cathodes.

What is claimed is:

1. A thermionic cathode comprising:

(a) a body including a plurality of alternating layers of polycrystalline base material and electron emissive material, each of said layers of polycrystalline base material comprising crystallites oriented such that facets thereof collectively form a diffusion surface, each of said layers of electron emissive material being disposed on a respective one of said diffusion surfaces, ends of said alternating layers being shaped to collectively form an electron emission surface which macroscopically makes an oblique angle with said diffusion surfaces; and (b) a quantity of electron emissive material disposed on at least portions of the electron emission surface located to receive desorbing electron emissive material from the diffusion surfaces.

2. A thermionic cathode as in claim 1 where the ends of the layers of polycrystalline base material are shaped to form a series of microscopic steps and where the ends of the layers of electron emissive material form treads on said steps, said treads serving as the quantity of electron emissive material disposed on portions of the electron emission surface.

3. A cathode as in claim 1 including a coating of polycrystalline base material on the electron emission surface.

4. A thermionic cathode as in claim 1, 2 or 3 where the layer of electron emissive material consists essentially of an element from the scandium group and where the layer of polycrystalline base material consists essentially of tungsten.

5. A thermionic cathode as in claim 4 where the layer of electron emissive material consists essentially of thorium.

6. A thermionic cathode as in claim 1, 2 or 3 where said angle lies in the range of 10° to 70°.

7. A thermionic cathode as in claim 6 where said angle is approximately 45°.

8. A thermionic cathode as in claim 1, 2 or 3 where the layers of polycrystalline base material each have a thickness from 0.5 to 20 micrometers, and where the layers of electron emissive material each have a thickness from 0.1 to 0.5 micrometers.

9. A method of manufacturing a thermionic cathode comprising the steps of:

(a) alternately depositing from the gaseous phase, onto a substrate, a plurality of layers of polycrystalline base material and of electron emissive material, each of said layers of polycrystalline base material being deposited such that crystallites thereof have facets oriented to collectively form a diffusion surface, each of said layers of electron emissive material being deposited on one of said diffusion surfaces; and (b) shaping the ends of said alternately deposited layers to form an electron emission surface which macroscopically makes an oblique angle with the diffusion surfaces.

10. A method as in claim 9 where the layers are formed by reactive deposition and where the flow rates of gases taking part in the reaction are periodically varied.

11. A method as in claims 9 or 10 where the layers of polycrystalline base material are deposited such that the facets forming the diffusion surfaces have a <111> orientation and are doped for structure stabilization with up to 2% by weight of $ThO_2$, $ZrO_2$, $Y_2O_3$, $Sc_2O_3$ or Ru.

12. A method as in claim 9 or 10 where a portion of the end of each layer of polycrystalline base material is removed to form a series of microscopic steps of which the ends of the layers of electron emissive material form treads.

13. A method as in claim 12 where said ends are removed by etching.

14. A method as in claim 12 where said ends are removed by electron beam evaporation.

15. A method as in claim 12 where said ends are removed by laser beam evaporation.

16. A method as in claim 12 where said ends are removed mechanically.

17. A method as in claim 9 or 10 where step b is followed by the deposition onto the electron emission surface of a coating of polycrystalline base material.

18. A method as in claim 9 or 10 where said alternately deposited layers are deposited in grooves of a substrate, said layers taking the shape of said grooves.

* * * * *